United States Patent [19]

Landwehr et al.

[11] Patent Number: 4,498,407

[45] Date of Patent: Feb. 12, 1985

[54] SEWING MACHINE WORK PIECE TURNING DEVICE

[75] Inventors: Günter Landwehr, Bielefeld; Horst Meyer, Bad Salzuflen, both of Fed. Rep. of Germany

[73] Assignee: Koch Adler AG, Fed. Rep. of Germany

[21] Appl. No.: 491,266

[22] Filed: May 4, 1983

[30] Foreign Application Priority Data

May 6, 1982 [DE] Fed. Rep. of Germany ..... 3216995
Sep. 23, 1982 [DE] Fed. Rep. of Germany ... 8226771[U]

[51] Int. Cl.[3] ..... D05B 35/10; D05B 39/00

[52] U.S. Cl. ..... 112/308; 112/DIG. 2; 112/121.15; 112/153; 112/237

[58] Field of Search ..... 112/236, 308, DIG. 2, 112/153, 121.15, 121.24, 121.28, 149, 237

[56] References Cited

U.S. PATENT DOCUMENTS

| | | | |
|---|---|---|---|
| 2,879,875 | 3/1959 | Swackhamer | 112/121.15 X |
| 4,133,279 | 1/1979 | Wajcmann | 112/153 |
| 4,226,197 | 10/1980 | Pollmeier et al. | 112/308 X |

FOREIGN PATENT DOCUMENTS

| | | | |
|---|---|---|---|
| 1485331 | 2/1964 | Fed. Rep. of Germany . | |
| 1685079 | 7/1967 | Fed. Rep. of Germany . | |
| 2632366 | 1/1978 | Fed. Rep. of Germany | 112/153 |
| 2839399 | 3/1980 | Fed. Rep. of Germany | 112/DIG. 2 |
| 2062707 | 5/1981 | United Kingdom | 112/DIG. 2 |
| 0918224 | 4/1982 | U.S.S.R. | 112/DIG. 2 |

*Primary Examiner*—Werner H. Schroeder
*Assistant Examiner*—Andrew M. Falik
*Attorney, Agent, or Firm*—Laff, Whitesel, Conte & Saret

[57] ABSTRACT

A sewing machine has a feed for the workpiece which is to be sewn. A workpiece conveyor performs a skipping feed movement below the workpiece. Above the workpiece a turning device enables the workpiece to be turned about an axis which is coincident with the needle. In order to sew in an edge-parallel manner with an automatic guidance, workpieces made from soft materials with curved or angular seam courses, may be turned responsive to air nozzles directed in acutely-angled manner on to the supporting plate. The air nozzles are arranged tangentially, and in spaced manner, with respect to the needle.

15 Claims, 12 Drawing Figures

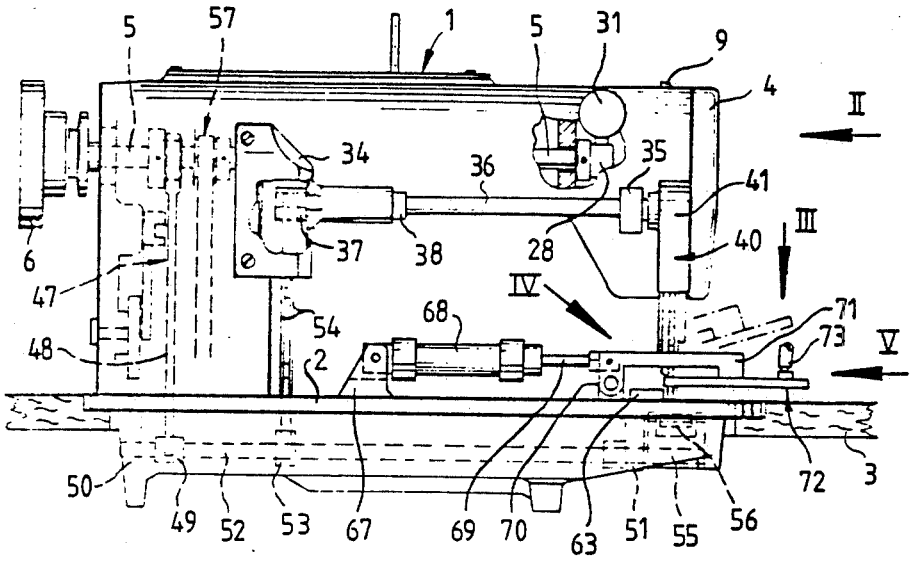

SEWING MACHINE WORK PIECE TURNING DEVICE

BACKGROUND OF THE INVENTION

This invention relates to sewing machines and more particularly to means for turning a workpiece in the sewing machine.

A sewing machine is disclosed in German Patent Specification No. 1,685,079. The torque in this German patent machine presses the edge of a workpiece in the area which is still to be sewn, against a guide edge responsive to an advance of the conveyor. In order to be able to produce seam profiles in corners, for example, at collar tips and the like, a turning device is mounted on the upper side of the workpiece to turn it by the necessary angle about the needle axis. Such a turning device is very complicated, because it requires a separate drive motor. The turning device is unsuitable for sewing curved seams, where direction changes occur between the individual stitches, because it is not possible to raise, re-apply and actuate within in each one stitching cycle in view of the sewing speeds that are used. There is also a considerable risk of deforming workpieces made from soft materials.

German Patent Specification No. 1,485,331 discloses a workpiece guidance device for sewing machines, in which the workpiece edges are folded over. At least one air set nozzle is provided to ensure that the workpiece always engages a guide edge in the folding device. The air jet presses the workpiece against the guide edge, at right angles to the sewing direction. It is also possible to provide air nozzles acting in the sewing direction, which compensate for the frictional forces occurring in the folding direction.

An object of the invention is to provide a sewing machine in which it is possible to sew workpieces in an edge-parallel manner. The workpieces are made from soft materials and may have curved or angular seam profiles which are followed by automatic guidance devices.

SUMMARY OF THE INVENTION

Accordingly, the invention has a sewing machine comprising a feed dog for a workpiece which is to be sewn. The feed dog has a workpiece conveyor for performing a skipping feed and adapted to be positioned beneath the workpiece. A supporting plate has a guide edge for orientating and guiding the workpiece. A needle and a turning device are arranged above the workpiece and are arranged for turning the workpiece about an axis coinciding with the needle. The turning device has air nozzles which are arranged in a tangentially spaced manner with respect to the needle and which are directed in an acute-angled manner on the supporting plate.

FEATURES AND ADVANTAGES

As a first advantage, the workpiece is always accurately guided along the guide edge, particularly when sewing highly curved or angular seam profiles. No importance is attached to the number of stitches over which the seam area extends. Since there is no positively working turning device, it is also possible to work softer materials, which are always pressed against the bearing edge, but which are not deformed by crinkling or the like.

Another advantage is a particularly simple construction because the air nozzles are arranged in an air chamber or hollow plate which may be subsequently fitted to existing sewing machines at a limited cost. The hollow plate is preferably arranged immediately above, but not in contact with the workpiece. As a result of this arrangement, the workpiece is satisfactorily turned, without introducing new frictional forces. Preferably, the hollow plate is pivotally mounted for movement toward and away from the workpiece to ensure that the insertion and removal of a workpiece are not impeded at the stitch formation point.

Still another advantage occurs because the air nozzles are arranged on approximately half pitch circles around the needle and the needle is located on the side remote from the guide edge. This arrangement leads to an optimum turning and orientation. The tangential direction of the air nozzles is desirably adjustable. Compressed air is supplied to the air nozzles only when a workpiece is to be stitched with curved or angular seams. This arrangement ensures that normal guidance of the workpiece takes place along the guide edge with linear or slightly curved seams, and that the turning device is operated only with highly curved or angular seam portions.

In addition, the presser foot is raised from the workpiece by means of a lifting gear during the stitching cycle. The lifting gear operates during the insertion of the needle when the presser foot is raised from the workpiece during the downwardly directed needle movement just prior to the bottom dead center position.

The workpiece can then be turned freely about the needle and with the needle actually inserted into the workpiece.

Preferably, the lifting gear has a cam plate drive which is driven by an arm shaft coupled through a transmission rod to presser foot bar. The position and lift of the presser foot may be adjustable. A workpiece braking device may be arranged alongside the guide edge to ensure that there is no rebounding of the material being pressed by the air nozzles.

The workpiece braking device may be a brush with bristles directed toward the supporting plate. The bristles preferably slope toward the guide edge, at an angle of about 30° to 60°, which provides a free-running effect, i.e. the fabric workpiece can be pressed under the bristles and against the guide edge, but it cannot move back again. However, no forces are exerted on the workpiece in other directions. There is a particular effect if the brush is elongated and is substantially perpendicular to the guide edge. The braking device is advantageously connected to the edge.

BRIEF DESCRIPTION OF THE DRAWINGS

The invention will now be further described, by way of example, with reference to the drawings, in which.

DESCRIPTION OF PREFERRED EMBODIMENTS

Figure 1:
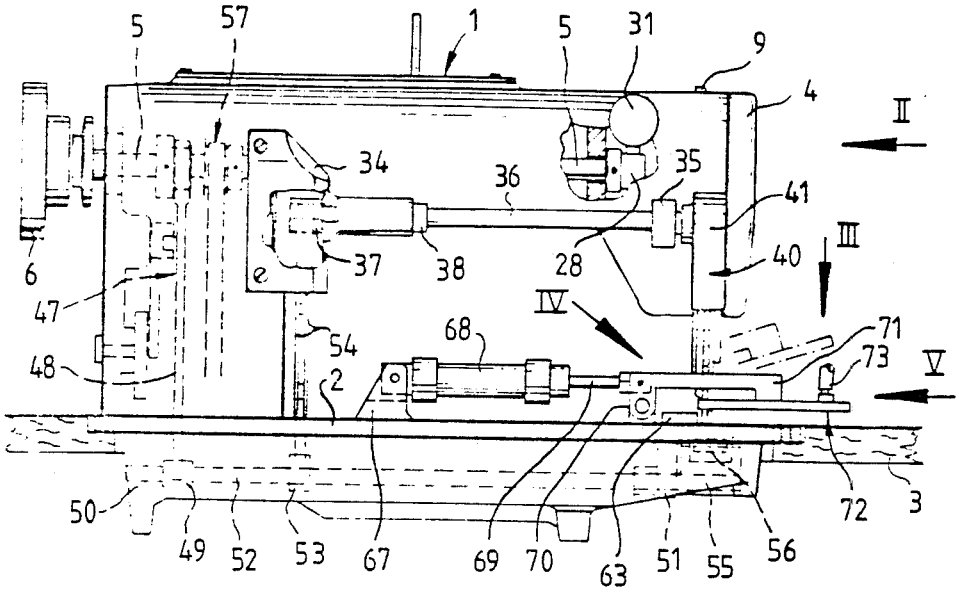
FIG. 1 is a rear view of one embodiment of an inventive sewing machine.

A sewing machine 1 has a lower arm constructed on base plate 2 received in a workpiece supporting plate 3. A hollow upper arm 4 is constructed as a housing, and is fixed to the base plate 2. A rotable arm shaft 5 is mounted in upper arm 4 and has a handwheel 6 at one end and the other end is free. The free end terminates in convention crank gear (not shown), which is used for driving a needle bar 7 with a needle 8.

A presser foot bar 9 is displaceably mounted in the upper arm 4 (FIG. 2) and with its lower end secured to a presser foot 10. The presser foot 10 is constructed with a guide roller 11 and a groove 12 for receiving a timing belt 13. The presser foot bar 9 is surrounded by a compression spring 14, one end of which is supported by means of a disk 15 on the upper arm 4. The other end of the spring is supported on a bearing block 16, which is fixed by means of a setscrew 17 to the presser foot bar 9. To the bearing block 16 is hinged a tie rod 18, having a free end which is held and guided in a rotary, adjustable manner in an oblong hole 20 of a lever 21 by means of an adjusting screw 19. This oblong hole fixture is used for adjusting the height of the lift a (FIG. 5*b*) of the presser foot 10. Consequently, adjustments in the hole bring about an adaptability to different compressibilities of the workpiece materials.

The lever 21 is fixed to a shaft 22, which is rotatably mounted in the arm 4. One end of a lever 24 is adjustably fixed by a clamping connection 23 to the shaft 22. The lever has a recess 25 for receiving a roller 27 which is rotatably mounted on a bolt 26. The roller 27 is in contact with a cam disk 28 secured in an angularly adjustable manner to the arm shaft 5. At its free end 29, i.e. at the end opposite the clamping connection 23, the lever 24 has a bearing surface 30.

Screws 32 secure one-way pneumatic cylinder 31 to the upper arm 4. The cylinder has a piston rod 33 which projects into the upper arm 4 above the arm shaft 5. Rod 33 can co-operate with the bearing surface 30 of the lever 24. There is a driving connection between the cylinder and the presser foot bar 9, which forms a lifting gear H. Adjustment of the height a (FIG. 5*b*) of the bearing block 16 on the presser foot bar 9 and/or a corresponding adjustment to the clamping connection 23, makes it possible to adapt the stroke length of the presser foot 10 to different workpiece thicknesses.

Figure 2:
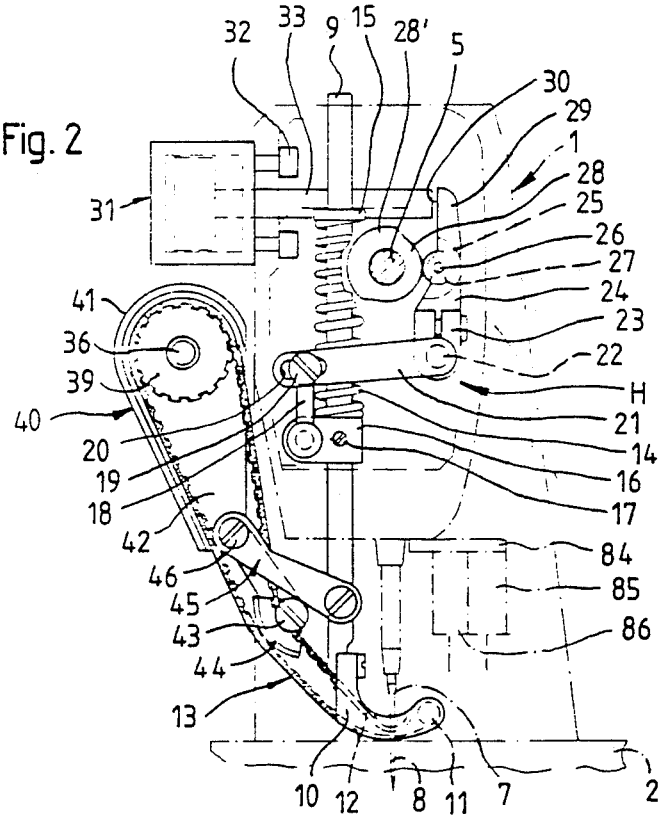
FIG. 2 is a side view of the sewing machine taken in the direction of the arrow II in FIG. 1.

A shaft 36, extending parallel to the arm shaft 5, is pivotably mounted in bearings 34, 35 on the upper arm 4 (FIG. 1). One end of the shaft 36 projects into a ratchet brake (not shown) with laterally positioned bearings (Torrington type). Such constructions are, for example, known from U.S. Pat. No. 4,271,776. This ratchet brake is connected to a crank 37. Laterally of the bearing 35, one end of the shaft 36 is axially fixed by means of an adjusting ring 38. The other end, facing the presser foot 10, is connected in a non-rotary manner to a gear wheel 39, around which passes the timing belt 13. A rocking lever 40 is pivotably mounted on the shaft 36, the lever having a cap 41 covering the gear wheel 39 and a downwardly radially extended lever 42 (FIG. 2). The lower end of the lever 42 carries a guide member 44 for the timing belt 13. Member 44 is fixed to the lever 42 by means of a screw 43. One end of a guide lever 45 is fixed by a shoulder screw 46 to the lever 42 and its other end is secured to the presser foot bar 9.

Within the upper arm 4 is arranged a conventional stitch regulating gear 47, which is connected to a crank 49 by means of tie rod 48. The crank 49 is mounted in non-rotary manner on a sliding shaft 52 which is mounted in bearings 50, 51 below the base plate 2, while another crank 53 is fixed in a non-rotary manner to the shaft 52. Cranks 53 and 37 are connected in a driving manner by means of a tie rod 54. The sliding shaft 52 has a feed fork 55, connected by means of a bolt (not shown) to a feed dog beam 56, which is supported by a crank (not shown) on an eccentric lug of a shaft (not shown) connected to the arm shaft 5 by means of a timing belt gear 57.

In the vicinity of the needle 8 (FIGS. 3, 4), a feed dog 58 is arranged on the feed dog beam 56 (FIG. 1). A throat plate 62 (FIG. 4) having a recess 60 for the feed dog 58 and a needle hole 61, is secured by means of screws 59 (FIG. 3) to the base plate 2. A stop plate 63 is adjustable fixed, by means of a screw 66 engaging in an elongated slot 65 in stop plate 63, to the base plate 2, thus, the distance may be adjusted between a guide edge 64 of the stop plate 63 and the needle hole 61 and consequently the distance from a seam to the workpiece edge is also adjustable. In general, the guide edge 64 is linear and runs parallel to the conveying direction of the feed dog 58. In addition, in the conveying direction, the guide edge 64 extends on either side of a vertical line through the needle hole 61, so that the workpiece edge can be guided in all cases tangentially to the guide edge 64.

A bracket 67 is mounted on the base plate 2 which bracket rotatably receive a double-acting pneumatic operating cylinder 68. A piston rod 69 of the cylinder 68 is articulated in driving manner to bear upon a lever 71 mounted in a bearing 70 on the base plate 2. Lever 71 is arranged to rest on an airchamber in the form of a semicircular hollow plate 72 (FIG. 6) having a compressed air connection 73. The hollow plate 72 (FIG. 7) has an upper plate 74 and a spaced parallel lower plate 75 interconnected at their peripheries by means of a gasket 76 and rivets 77. The compressed air connection 73 in the upper plate 74 has a bonded-in stud 78 for receiving a hose 79. The upper and lower plates 74, 75, in conjunction with the gasket 76, enclose a flat compressed air distribution space 80.

Figure 3:
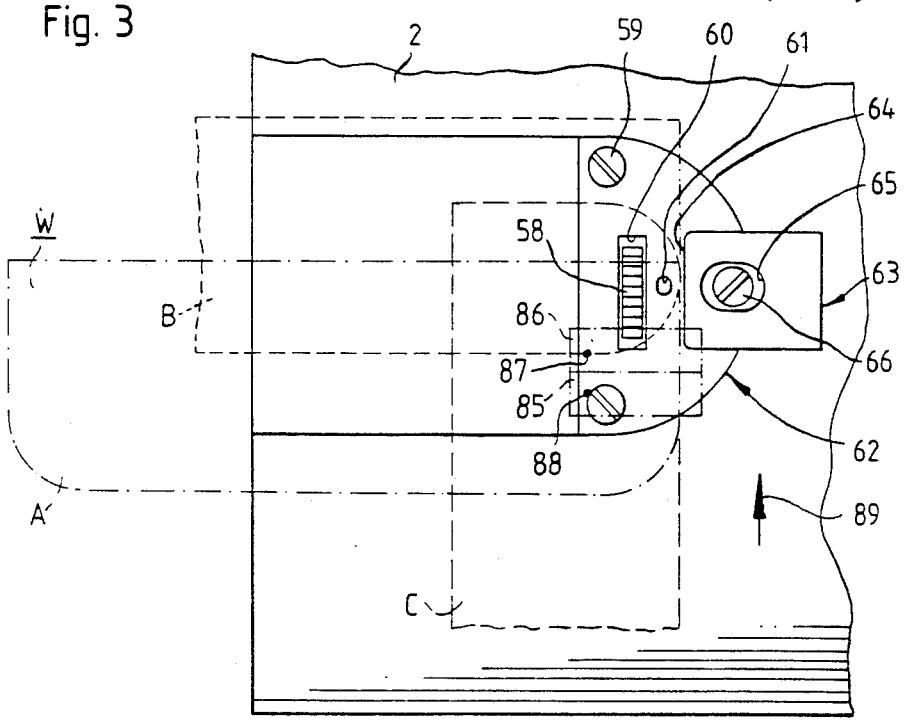
FIG. 3 is a plan view of the base plate of the sewing machine base plate taken in the direction of the arrow III in FIG. 1.
Figure 4:
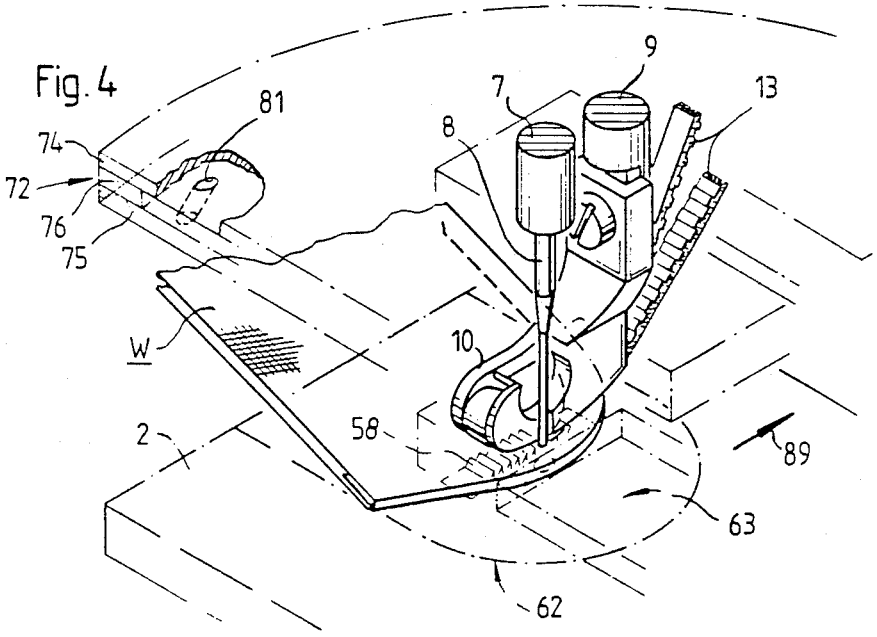
FIG. 4 is a perspective view taken in the direction of the arrow IV in FIG. 1.

The lower plate 75 has air jet nozzles 81 arranged at an acute angle of 30° to 60° with respect to the plate plane, the nozzles being arranged on the concentric pitch circles 82, 83, extending approximately 180° with respect to the needle 8, i.e. the needle hole 61. The jets are constructed tangentially to the pitch circles 82, 83. The direction of the air nozzles 81 is such that the trailing, i.e. not sewn edge of the workpiece W, is pressed against the guide edge 64 (FIG. 3).

The presser foot 10 and the feed dog 58 form a feeding device. As is conventional, the feed dog has a four-motion feed movement for causing a skipping feed.

As shown in FIG. 2, two reflection barriers 85, 86 are arranged on a plate 84 which is secured to the upper arm 4 of the sewing machine. These barriers form switch points 87, 88 (FIG. 3).

The operation takes place as follows. It is assumed that before the start of a work cycle, the needle 8 of the sewing machine is in its uppermost position. Due to the operation of the working cylinder 31, the presser foot 10 is in the raised position. Due to the operation of the working cylinder 68, the hollow plate 72 is in the raised position, indicated by the dot-dash lines in FIG. 1. The operation of the working cylinder 31, i.e. the extension of its piston rod 33, ensures, through the engagement and co-operation of rod 33 with the bearing surface 30, so that the lever 24 is pivoted around the shaft 22, and so that simultaneously the lever 21 is rotated. The upward movement of the lever 21 is transmitted by means of the tie rod 18 to the bearing block 16. The presser foot bar 9 is raised against the force of the compresion spring 14, so that the presser foot 10 is disengaged from the throat plate 62. During the upward movement of the presser foot bar 9, by means of the guide lever 45, the lever 42 and consequently the guide member 44 is pivoted away from the presser foot bar 9. The timing belt 13, constructed as the upper material displacement means, remains in the tensioned position. By operating the cylinder 31, the roller 27 is simultaneously moved out of the action area of the cam disk 28.

A workpiece W, shown in exemplary manner in FIG. 3, is now placed in an initial position A on the base plate 2 of the sewing machine 1. The outer workpiece edge is placed against the guide edge 64 of the stop plate 63. As can be gathered from FIG. 3, the workpiece W introduced in the represented manner, covers the switch points 87, 88 of the reflection barriers 85, 86, so that the latter emit a signal identifying the presence of a workpiece. The sewing machine 1 can now be started.

After operating a starting button (not shown) of a control means, initially the pneumatic working cylinders 31 and 68 are reversed. The presser foot 10 is lowered on to the workpiece W and the air chamber or hollow plate 72 is lowered to its lower position immediately, but not in contact, with the workpiece W. On rotating the arm shaft 5, an oscillatory movement is produced in the stitch regulating gear 47 (FIG. 1), which causes an intermittent movement of the shaft 36 and consequently of the timing belt 13, as the upper material displacement means, due to the ratchet brake located in the crank 37.

Figure 5A:
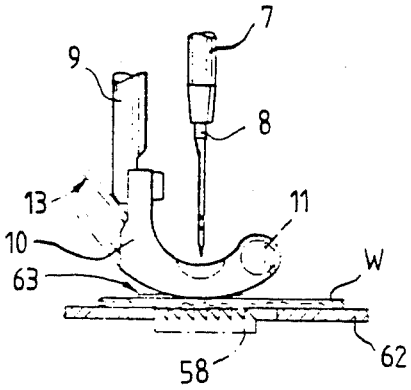
FIGS. 5*a* to 5*c* show the stitch formation area of the sewing machine taken in the direction of the arrow V in FIG. 1 and showing different phases of the needle movement.
Figure 5C:
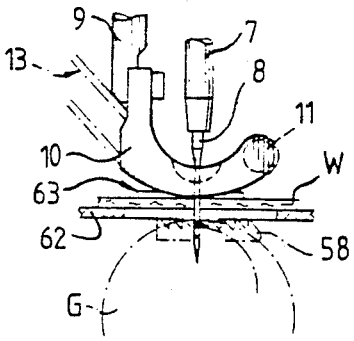
Figure 5B:
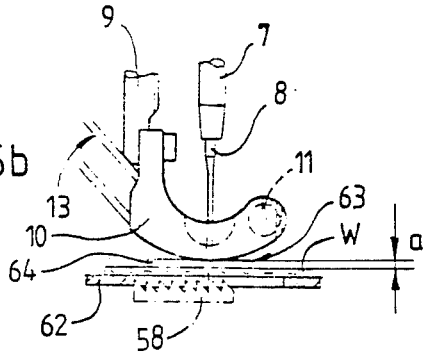

Simultaneously, the feed dog 58 (FIG. 3) performs a feed movement, so that the workpiece W is moved in the direction of arrow 89. As soon as the tip of the needle 8 penetrates the workpiece W, cf FIG. 5*b*, the cam disk 28 with its operating cam 28' runs on to the roller 27 and pivots the lever 24. By means of the lever 21, the presser foot bar 9 and consequently the presser foot 10 is raised by a small amount from the workpiece W, which corresponds to the height of lift a (FIG. 5*b*). Simultaneously, the feed dog 58 has assumed a position in which it is located below the bearing surface for the workpiece W, i.e. below the surface of the throat plate 62. Since no frictional forces are now exerted by the timing belt 13, in the form of either the upper material displacement means, or the feed dog 58 on the workpiece W, the workpiece can be easily orientated with respect to the guide edge 64 of the stop plate 63 as will be described in detail hereinafter.

During further stitch formation, the needle 8 performs its downward stroke into the lowermost position, i.e. down to bottom dead center from which it moves upwardly, at the beginning of which the loop lifting movement necessary for stitch formation takes place. When, during its downward movement, the needle 8 reaches bottom dead center, the presser foot 10 is again lowered on to the workpiece W, due to the corresponding shaping of the operating cam 28' (FIG. 2) of the cam disk 28. During the formation of the thread loop (FIG. 5*c*), which is seized by hook G, the workpiece W is held firmly on the throat plate 62. The presser foot 10 simultaneously carries a circulating material displacement means (timing belt 13). At this time, the presser foot fulfils the function of a presser pad for the workpiece W. The needle 8 is moved further upwardly during the continuing stitch formation cycle. When the needle 8 has left the workpiece W, it is again moved and the operation can be repeated to form another stitch.

Due to its own weight, the workpiece W rests on the base plate 2 or the workpiece supporting place 3 (FIG. 1), also outside the stitch formation zone and essentially in the area located beyond the needle hole 61 or the needle 8, when viewed from the guide edge 64. The conveyor 58 and timing belt 13 impart movement to the workpiece W in the sewing direction 89. This movement leads to a torque being produced on the workpiece W, which acts around the needle 8, i.e. around the stitch formation point. The torque presses the workpiece by its edge located in front of the stitch hole 61 in the sewing direction 89 and against the guide edge 64. Consequently, the not yet sewn edge area of the workpiece is always turned toward the guide edge 64. Thus, in FIG. 4, the torque always acts counterclockwise.

Since the presser foot 10 is always raised from the workpiece during part of the needle stroke, this rotary movement is always facilitated from the feed in the sewing direction 89. The force with which the edge of the workpiece W engages the guide edge 64 of the stop plate 63 is sufficient for guiding workpieces W with a relatively flat, convex or concave configuration. However, it is not adequate for guiding highly curved configurations. For guiding a workpiece W in the vicinity of tighter curves, such as collar tips and the like, the aforementioned air chamber or hollow plate 72 is used, which is controlled by a control means (not shown), in the same way as the reflection barriers 85, 86.

As soon as the workpiece W has been transferred from the initial position A into position B, in accordance with FIG. 3 and in which the previously linear seam course changes into a highly curved course in which the workpiece is freed from the first switch point 88, the reflection light barrier 85 emits a signal indicating that a workpiece is not present at switchpoint 88. Compressed air is then supplied to the air chamber or hollow plate 72 (FIG. 7) via the hose 79, which passes into the compressed air distribution space 80. As a result of the arrangement of the air nozzles 81, a torque is imparted to the workpiece W in the direction of arrow 90 (FIG. 6) that during the next-following highly curved seam course, the workpiece W is held and guided on the guide ege 64 of the stop plate 63 during each stitch. As soon as the workpiece W has been turned during stitch formation by the air from the air nozzles 81 in such a way that the workpiece W is again positioned above the switch point 88, a corresponding signal is given by the reflection light barrier 85. The air supplied to the air chamber or hollow plate 72 is switched off after predetermined delay time in the control means not shown. Such a delay time is necessary in order to ensure that the workpiece W rotates beyond the switch point 88 positioned laterally of the guide edge 64, for example up to position C in FIG. 3. During the production of the seam in the further curved portion, the workpiece W is guided and rotated in the normal manner. If at the end of the seam, the workpiece is freed from both switch points 87, 88, thread cutting-off takes place in the conventional manner. The pneumatic working cylinders 31, 68 are operated, so that the completed workpiece W can be removed from the sewing machine 1.

Figure 6:
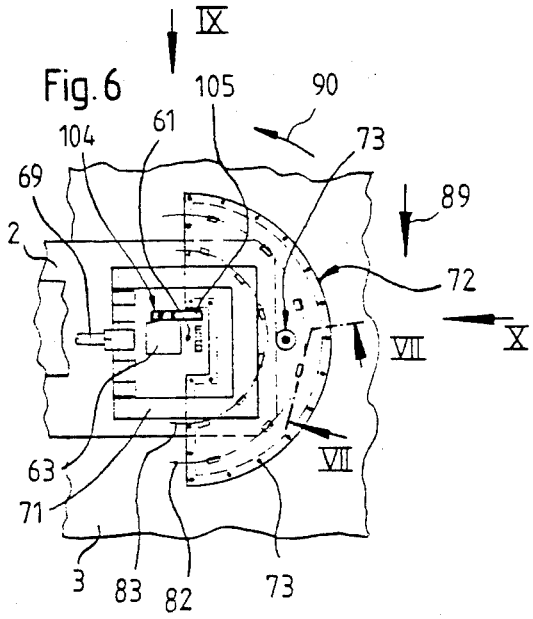
FIG. 6 is a plan view of the stitch formation point with a turning device taken in the direction of the arrow III in FIG. 1.
Figure 7:
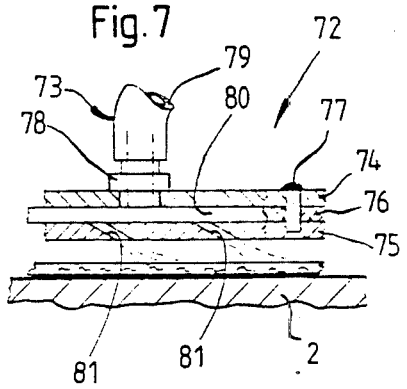
FIG. 7 is a partial section taken along the section line VII—VII in FIG. 6.
Figure 8:
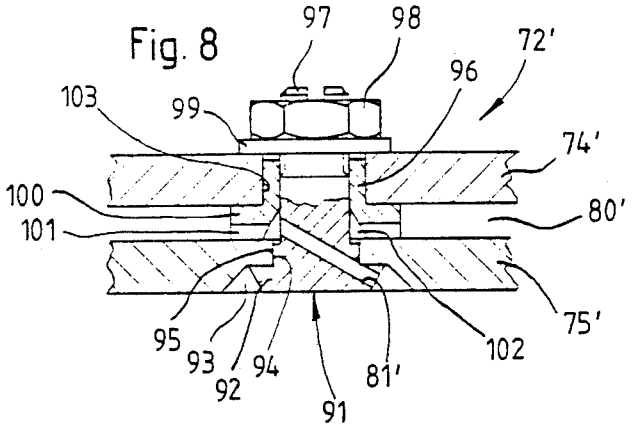
FIG. 8 is a section, corresponding to FIG. 7, but showing a modified embodiment.

The air chamber or hollow plate 72' partially shown in FIG. 8 corresponds, as regards its basic construction, to the hollow plate 72 shown in FIGS. 6 and 7, so that in this respect what has been stated hereinbefore also applies. Plate 72 has an upper plate 74' and a lower plate 75', bounding between them a compressed air distribution space 80'. However, unlike the embodiment of FIGS. 6 and 7, the direction of air nozzles 81' is adjustable. For this purpose, the air nozzles 81' which slope downwards at an acute angle of 30° to 60° with respect to the plate plane, are each constructed in a swivel member 91, arranged with a lower, approximately flange-shaped head 92 in a corresponding recess 93 on the bottom of the lower plate 75'. The recess 93 widens downwardly in frustum-shaped manner. The periphery of the head 92 tapers downwardly in frustum-shaped manner. The particular air nozzle 81' issues into the V-shaped slot formed by the shaped surfaces of the head 92 and recess 93. The swivel member 91 has a lug 94 joined to the head 92 by means of which the swivel member is sealingly held and guided in a rotatable manner in a corresponding bore 95 in the lower plate 75'.

A larger diameter bore 103 aligned with the bore 95 is provided in the upper plate 94' and a bushing 96 is arranged in the bore. The swivel member 91 extends through the bushing 96 and has a screw-thread 97 at its upper free end, which is engaged by a nut 98, with the interposition of a washer 99, to hold the swivel member 91 in position. At its inner end, the bushing has a spacer ring 100 which determines the distance between the upper plate 74' and the lower plate 75'. On its end face facing the lower plate 75', the spacer ring 100 has radially extending channels 101 which ensure a connection between the compressed air distribution space 80' and the particular air nozzle 81'. A frustum-shaped annular channel 102 is also provided on the associated inside of the bushing 96. Prior to the final tightening of the nut 98, each swivel member 91 is aligned in such a way that the associated air nozzle 81' extends precisely tangentially to the particular pitch circle 82 or 83.

With this construction, it is no longer necessary to connect the upper plate 74' and lower plate 75' by means of rivets or the like, because the swivel members 91 with nuts 98 and spacer rings 100 fulfil these functions.

Figure 9:
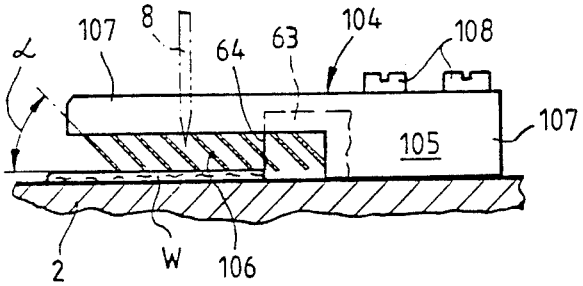
FIG. 9 is a view taken in the direction of the arrow IX in FIG. 6 but with the turning device omitted and showing a workpiece braking device.
Figure 10:
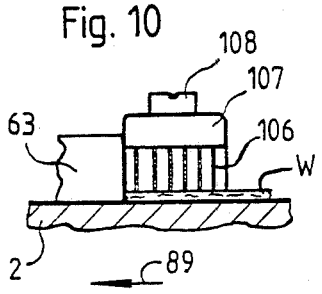
FIG. 10 is a view of the workpiece braking device taken in the direction of the arrow X in FIG. 6 but again with the turning device omitted.

As can be seen in FIG. 6, in front of the stitch hole 61 there is a workpiece braking device 104, which comprises a brush 105, the bristles 106 (FIG. 9) of which are directed downwardly from a cantilever-shaped bristle body 107 to the base plate 2 and the guide edge 64. The bristles 106 form an angle of 30° to 60° and preferably 45° with respect to the base plate 2, with the upper ends of the bristles pointing away from the guide edge 64. At a section without bristles 106, the bristle body 107 is screwed onto the base plate 2 by means of screws 108 and is thereby connected to the stop plate 63. As shown in FIGS. 9 and 10, the section of the bristle body 107 with bristles 106 is long in proportion to its width. The main length of the bristle body 107 extends transversely with respect to the sewing direction 89. Seen in the sewing direction 89, the brush 105 is fastened immediately in front of the stop plate 63. The section of the brush 105 having bristles 106 is arranged centrally in front of the needle 8.

The bristles 106 may project upwardly to the base plate 2; however, they may also terminate shortly above it. In each case, they should rest against the upper surface of an available workpiece and prevent the workpiece from being lifted from the guide edge 64 and especially from being rebounded from the guide edge 64 when turned against it by means of the air nozzles 81, 81'. The braking device 104 and the brush 105 may also be fastened to the lower surface of the air chamber or hollow plate 72 or 72'.

The invention is not restricted to the above-described embodiments but modifications and variations may be made without departing from the scope of the invention as defined by the appended claims.

We claim:

1. A sewing machine having a sewing station with at least a needle and a presser foot, means including a four motion feeding dog for feeding a workpiece past said sewing station, a supporting plate positioned near said needle and having a guide edge for orienting said workpiece relative to said needle, turning means comprising an air chamber positioned above said work piece for turning said workpiece about an axis coinciding with the needle, a plurality of air nozzles leading from said air chamber for directing air jets from said nozzles in a spaced manner which is tangentially directed with respect to said needle and in an accutely angled manner toward said support plate, and means for pivotally moving said air chamber toward and away from said workpiece.

2. The sewing machine as claimed in claim 1 in which the air chamber comprises a hollow plate arranged immediately above the workpiece but not in contact therewith.

3. The sewing machine as claimed in claim 1 in which the air nozzles are arranged on approximately half pitch circles about said needle and are located on side side of the needle which is remote from said guide edge.

4. The sewing machine according to claim 1 and means for adjusting the tangential direction of said air nozzles.

5. The sewing machine as claimed in claim 1, and means for ensuring that compressed air is supplied to said air nozzles only when a workpiece is to be stitched with curved or angular seams.

6. The sewing machine as claimed in claim 1, and a lifting gear means for lifting the presser foot from the workpiece during the stitching cycle of the needle, the lifting gear means being constructed in such a manner that during the insertion of the needle, said presser foot is raised from the workpiece during a downwardly directed movement of said needle just prior to reaching the bottom dead center position.

7. The sewing machine as claimed in claim 6, in which the lifting gear has a cam plate drive which is driven by an arm shaft and which is coupled to a presser foot bar of said presser foot by means of a transmission rod.

8. The sewing machine as claimed in claim 6, and means for adjusting the lift by which said presser foot can be raised from the workpiece.

9. The sewing machine as claimed in claim 6, and means for adjusting the position to which said presser foot can be raised from the workpiece.

10. The sewing machine as claimed in claim 1 and a workpiece braking means directed toward the supporting plate, said braking means being positioned alongside said guide edge.

11. This sewing machine as claimed in claim 10, in which said workpiece braking means is constructed as a brush with bristles directed toward said supporting plate.

12. The sewing machine as claimed in claim 11, in which said bristles slope toward said guide edge.

13. The sewing machine as claimed in claim 12, in which said bristles slope with respect to the supporting plate by an angle of 30° to 60°.

14. The sewing machine as claimed in claim 11, in which the brush is elongated and is substantially perpendicular to said guide edge.

15. The sewing machine as claimed in claim 10, in which the braking means is connected to said guide edge.

* * * * *